United States Patent [19]

Chitjian

[11] Patent Number: 4,646,482

[45] Date of Patent: Mar. 3, 1987

[54] RECIRCULATING SANDBLASTING MACHINE

[75] Inventor: John R. Chitjian, Long Grove, Ill.

[73] Assignee: Clements National Company, Chicago, Ill.

[21] Appl. No.: 796,713

[22] Filed: Nov. 12, 1985

[51] Int. Cl.[4] ..... B24C 9/00

[52] U.S. Cl. ..... 51/424; 51/429

[58] Field of Search ..... 51/424, 425, 427, 410, 51/439, 429; 15/347, 352; 209/638, 643, 645

[56] References Cited

U.S. PATENT DOCUMENTS

| | | | |
|---|---|---|---|
| 537,160 | 4/1895 | King | 51/427 |
| 1,763,397 | 6/1930 | Hutchinson | 15/352 |
| 2,594,072 | 4/1952 | Ridley | 51/438 |
| 2,723,498 | 11/1955 | Hastrup et al. | 51/427 |
| 2,770,924 | 11/1956 | Mead et al. | 51/427 |
| 2,846,822 | 8/1958 | Steffen | 51/431 |
| 3,044,218 | 7/1962 | Munn | 51/424 |
| 3,618,297 | 11/1971 | Hamrick | 15/352 |
| 3,797,064 | 3/1974 | MacFarland | 15/352 |
| 4,232,487 | 11/1980 | Brown | 51/427 |

FOREIGN PATENT DOCUMENTS 0080784 11/1982 European Pat. Off. .

*Primary Examiner*—Frederick R. Schmidt
*Assistant Examiner*—Robert A. Rose
*Attorney, Agent, or Firm*—Hill, Van Santen, Steadman & Simpson

[57] ABSTRACT

A recirculating sandblasting device having a generally cylindrical body with a conical blasting medium bin is mounted on a cart and includes a cyclonic separator and a high capacity filter for filtering air drawn in by a blower and motor within a motor housing. A sandblasting head includes a supply line to draw blasting medium from the medium bin and a return nozzle with a resilient bellows connected to a recovery hose for returning laden air to the cyclonic separator in the body.

12 Claims, 5 Drawing Figures

FIG. 3
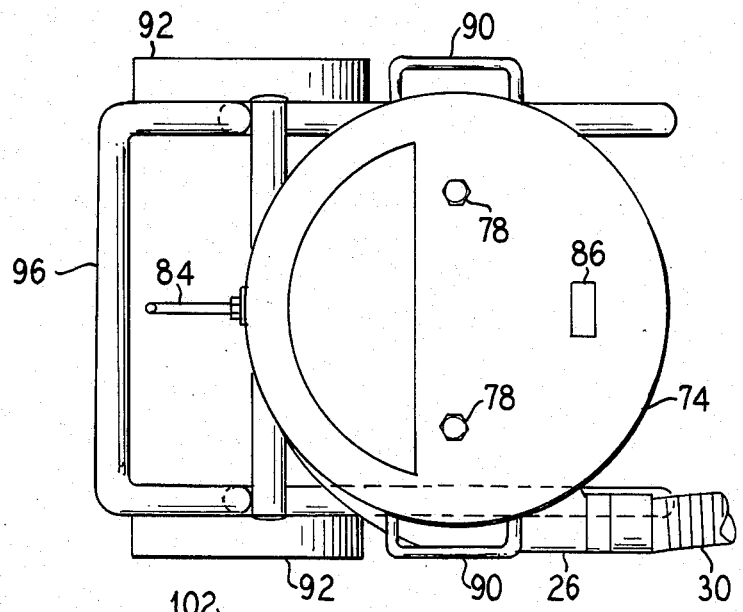
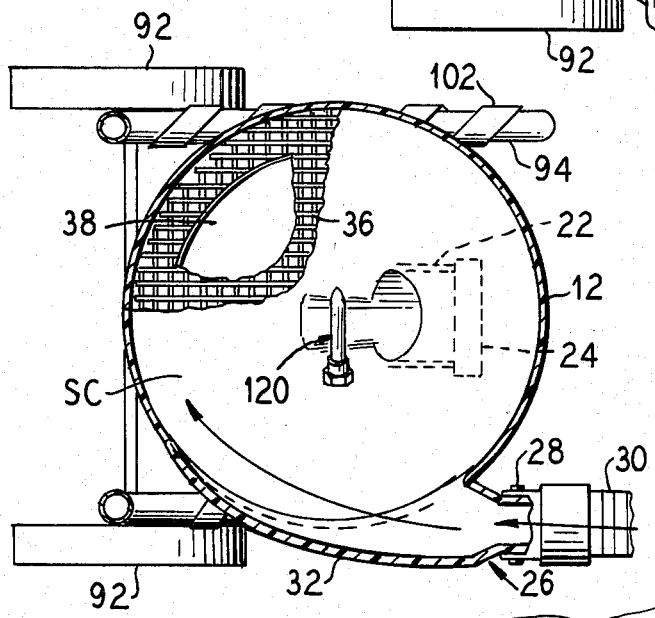
FIG. 2
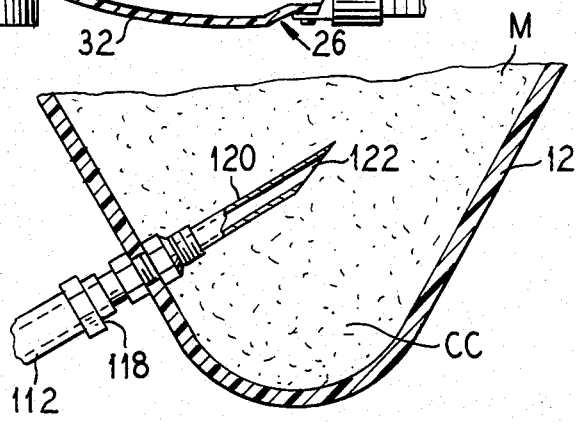
FIG. 4

RECIRCULATING SANDBLASTING MACHINE

BACKGROUND OF THE INVENTION

1. Field of the Invention

The present invention relates generally to a sandblasting device, and more particularly to a recirculating-type sandblasting device for re-use of the blasting medium.

2. Description of the Prior Art

Recirculating sandblasting devices are known in the art. One such recirculating sandblaster has a rigid hood encircling a blasting gun nozzle which is connected to a recovery tube. The recovery tube empties the recovered blasting medium through a right-angle conduit into a cylindrical vacuum device having a filter and blasting medium storage bin. Corrugated and pleated paper filters clean waste from the air.

It is also known to impeen a surface at a first angle with an airstream laden with a blasting medium and to exhaust the used blasting medium at a second angle for recovery.

SUMMARY OF THE INVENTION

The present invention provides a high capacity recirculating sandblaster which can be used effectively on both contoured and flat surfaces and which includes an improved cyclone separator with a conical collector chamber and an improved heavy duty two stage industrial filtering means for extended uninterrupted use. The present sandblasting device is durable, easy to use and relatively simple to manufacture.

The principles of the present invention are embodied in a recirculating sandblaster having a generally cylindrical body mounted on a wheeled cart. A sandblasting gun, or head, is connected to the cylindrical body by a supply hose and a return, or recovery, hose, and includes means for connecting the head to a high pressure air supply. The cylindrical body includes a blasting medium bin at a conical-shaped lower end and a motor housing mounted at an opposite upper end.

The body of the present device is formed in one-piece and is preferably rotationally molded of durable material which is strong and light weight. The conical shaped blasting medium bin at the lower portion of the body has a high capacity and, due to its conical shape, is easy to empty. In the body above the blasting medium bin is a cyclonic-type separator for separating the blasting medium and heavier waste from the air stream and thereafter depositing much of the lighter particulate material into a collecting receptacle.

A high capacity filter is provided between the cyclonic separator and a vacuum motor within the motor housing for extended uninterrupted use to insure a relatively clean air stream. The blasting head has a flexible recovery nozzle encircling a blasting nozzle for virtually complete recapture of the blasting medium. The recovery nozzle, which in a preferred embodiment is a rubberized bellows, is connected to the recovery tube by an angled return head for easier access to tight work locations.

The present invention thus provides an easily movable, highly efficient recirculating sandblasting device for use on various shaped surfaces with little loss of blasting medium or generation of ambient dust. The present device can be used with many different types of blasting media for example, silica sand, glass beads and plastic blast media, which, upon recapture is effectively separated from the air stream for reuse and which can be changed quickly for different surfaces to be sandblasted.

BRIEF DESCRIPTION OF THE DRAWINGS

FIG. 2 is a plan view of the device of FIG. 1.

FIG. 3 is a cross-section of the device of FIG. 1 along lines III—III.

FIG. 4 is an enlarged cross-section along lines IV—IV of FIG. 1 showing additional details of a pick-up tube.

DESCRIPTION OF THE PREFERRED EMBODIMENTS

Figure 1:
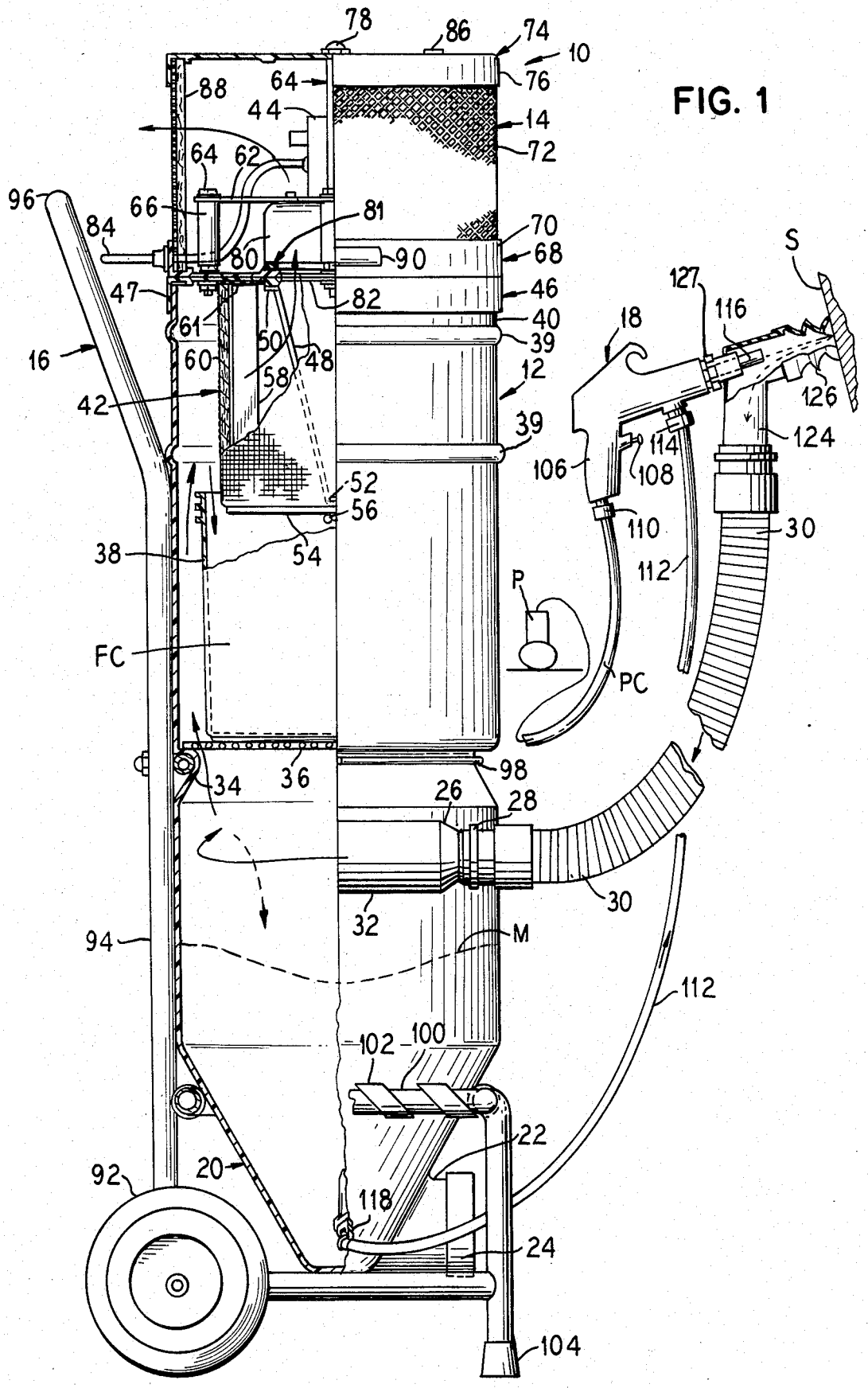
FIG. 1 is a side elevational view, partially in cross-section of the recirculating sandblasting device according to the principles of the present invention.

A recirculating sandblaster is shown generally at 10 including a generally cylindrical body 12, a motor housing 14, a cart 16 and a blasting head 18. The body 12 has an overall cylindrical shape with a generally conical lower portion 20. A removal opening, or chute, 22 having a removable closure cap 24 thereover projects laterally from an apex of the conical portion 20. The closure cap 24, which is preferably threaded over an annular flange 23 forming the opening 22, may be removed to empty contaminated blasting medium M from the device 10. The conical shape of the portion 20 enables the medium M to be collected expeditiously from a cyclonic separator and facilitates emptying such as by simply tilting the cart 16 forward toward the removal opening 22. A container can be placed under the opening 22 to catch the discharged contents.

In order to separate the blasting medium M and any entrained grit from the air stream, cyclonic separating means including a tangentially directed inlet 26 is formed in the body 12 above the conical portion 20. The tangentially directed inlet 26 includes a hose mounting 28 for securing a recovery hose 30 to the body 10 and a spiral portion 32 having a gradually decreasing radius which directs particle laden air into a cyclonic separating chamber SC formed in the body 12. The tangentially directed stream forms a vortex, as shown in FIG. 2. In accordance with the principles of cyclonic separation, the velocity head of the stream is converted into a static head and the heavier media in the air stream fall gravitationally into a collecting chamber CC at the lower end of the machine.

An inwardly projecting annular rib 34 is formed above the tangential inlet 26 and supports a removable wire shelf 36 thereon. Resting upon the wiree shelf 36 within the body 12 is a waste container 38, such as a bucket, forming a filter chamber FC. Additional reinforcing ribs 39 are provided on the body 12 for strength.

The air stream partially separated in the first stage cyclonic separator means SC and converted into a pressure head or static head is caused to change direction as shown by the arrows, thereby contributing to the separating action, and then passes into the filter chamber FC whereupon it will be drawn through the walls of the filtering medium by the motor-blower unit for discharge of a clean air stream to the ambient air.

The motor housing 14 rests upon an upper portion 40 of the body 12 and includes a heavy duty industrial filter assembly 42 and a motor 44. The filter assembly 42 is secured by a filter mounting strap 48 to a cover cap 46 and 68 which includes an annular rim 47 extending therearound that fits over the upper body end 40. In a preferred embodiment, the filter mounting strap 48 is a V-shaped member having first spaced ends 50 thereof secured to the cover cap 46 and 68 and a second intersecting end 52 affixed to a filter securing plate 54, such as by a wing nut 56.

Although many different types of filters may be used, in a preferred embodiment, the filter assembly 42 includes a cylindrical heavy duty corrugated and pleated thermoset resin paper filter 58 with a foam sleeve 60 mounted thereover to provide additional filtering action. The foam sleeve 60 has been found to extend filter life as well as being easy to clean such as by brushing surface accumulations therefrom or by washing in water.

A gasket 61 provides a seal between the filter assembly 42 and the cap 46. The filter assembly 42 extends slightly into the container 38 and thereby maintains a discrete filter chamber FC below and around the filter assembly 42. As dust and other fine waste material accumulates on the surface of the filter assembly 42, it may fall into the container 38, particularly as the motor 44 is shut off. The container 38 thereby prevents dust and other fine particulate matter which has been filtered from the air stream in its second stage of separation from being again commingled with the heavier particulate matter collected in the collecting chamber CC.

The motor 44 is mounted on a motor mounting bracket 62 within the motor housing 14 by threaded guide rods 64 extending through spacers 66 to cap members 68 and 46. The second cap 68 includes an annular rim 70 extending upwardly to engage an expanded flattened metal motor guard 72. The motor guard 72 is cylindrical and is engaged at an opposite end by a third cap member 74, which also includes an annular rim 76. The caps 46, 68 and 74, along with the motor guard 72, encase the motor 44. The motor housing 14 is held together by extended ones of the threaded rods 64 extending through the upper cap 74 and secured thereto by nuts 78, as can be seen in FIG. 3. In a preferred embodiment, the motor guard 72 is expanded flattened metal and the caps 46, 68 and 74 are molded plastic with radial reinforcement and are substantially identical to one another.

A vacuum blower 80 is connected to be driven by the motor 44 and is mounted to caps 46 and 68 in registration with openings 82 extending through both cap 46 and cap 68. A gasket 81 is provided between the blower 80 and cap 68 to prevent air leakage. Power is supplied to the motor 44 by a power cord 84 and is controlled by a switch 86. In one exemplary embodiment of the invention, the motor 44 is a 1.3 horsepower electric motor.

Air is exhausted from the blower 80 into the motor housing 14 and leaves the motor housing 14 through the expanded flattened motor guard 72. A foam silencer 88 is mounted on an inside surface of the motor guard 72 to muffle noise from the blower 80 and, thus, provide quiet operation of the device 10. Handles 90 are secured to opposite sides of the motor housing 14 by which the housing 14 can be lifted.

The cylindrical body 12 is mounted on a hand cart 16 having wheels 92 on a frame 94 to support and transport the device 10. The hand cart 16 includes a handle 96 and a U-shaped strap 98 which extends around the body 12 at the annular rim 34 to secure the body to the hand cart 16, as well as a circular support ring 100 engaging the conical portion 20. The support ring 100 may include webbing 102 wrapped therearound to prevent chafing and wear of the body 12. The preferred cart 16 has feet 104 opposite the wheels 92 at the lower end thereof so that not only is the sandblaster 10 stable as it rests on a surface but also to enable a user of the device 10 to tip the body 12 forward to ensure that all of the blasting medium M may be selectively removed from the device 10 through the opening 22.

The sandblasting gun, or head, 18 shown in FIG. 1 may be one of the known type of sandblasting guns. It includes a handle 106 having a trigger 108 and an air hose fitting 110. The gun 18 is powered by a pressurized air stream, preferably at a pressure of at least 75 p.s.i., and such pressurizing source can be any conveniently available pressure source shown schematically at P, either a portable compressor, or a bench connection if used in a shop or factory where a central source of compressed air is available. A media supply hose 112 is mounted to the sandblast gun 18 at a fitting 114 through which blasting medium M is supplied to the gun 18 by a Venturi action.

A blasting nozzle 116 extends forwardly from the sandblasting gun 18 which may be one of many known nozzle shapes, but in a preferred embodiment is a tubular machine steel nozzle with an abrasive resistant insert. The media supply hose 112 extends from the sandblasting gun 18 to a supply fitting 118 at the conical portion 20 of the body 12. As shown in FIG. 4, extending through the body 12 is a pickup tube 120 which has a mitered end 122 facing downwardly through which the blasting medium M is drawn into the supply hose 112. The mitered end 122 enables medium M be flow evenly into the pickup tube 120 without forming a vertical tunnel through the medium M and thereby drawing air.

A return, or recovery, hose 30 extends between the tangential inlet 26 and the sandblast gun 18 and is connected to a return nozzle 124 having a bellows 126 at an opposite end thereof encircling the sandblast nozzle 116. The return nozzle 124 is angled between the bellows 126 and the recovery hose 30 primarily to provide easy access to restricted locations, such as inside corners, when using the sandblasting gun 18. In a preferred embodiment, the angle of the return nozzle is 105° and the nozzle is formed of steel.

A compression fitting 127 is attached to the return nozzle 124 to position and secure the sandblast nozzle 116 from the work surface S without effecting the operation of the bellows 126 to the work surface S.

The bellows 126 is corrugated and is formed of resilient rubber so that it may easily be drawn against both flat and contoured surfaces S to be sand blasted. In one embodiment, the bellows 126 is formed of rubber having a flexibility of between 60 and 70 Durometer. Both flat and curved surfaces can be sandblasted using the present bellows without loss of blasting medium or generation of ambient dust since the vacuum created by the blower 80 tends to draw the bellows 126 against a surface S. The present bellows 126 has even been found to provide satisfactory operation on 90° outside corners with minimal leakage simply by urging opposing portions of the bellows 126 toward the adjoining surfaces in literally sealed relationship.

Although the bellows 126 is shown having a flat end face, bellows having shaped end faces may be selectively used simply replacing the bellows 126 with one of an optional configuration. Bellows having end faces adapted for use on inside corners, outside corners, and on ornamental contoured surfaces may be used, depending on the surface to be sandblasted.

Figure 5:
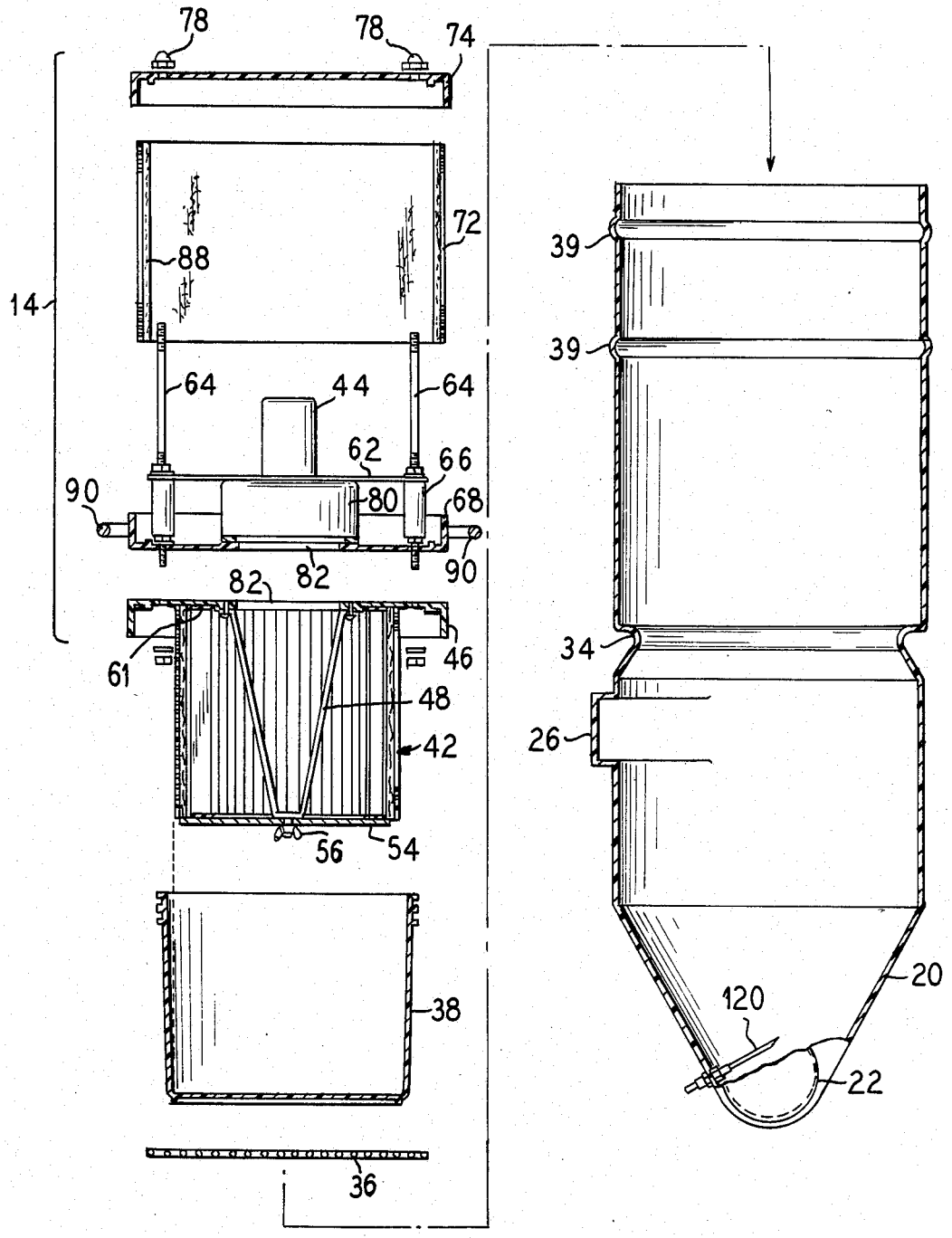
FIG. 5 is an exploded view of the device shown in FIG. 1.

Referring to FIG. 5, assembly and disassembly of the sandblasting device 10 can be easily accomplished for cleaning, replacing the filter 58, or the like. The body 12 is a one piece element which, in one embodiment, is rotationally molded polyethylene. The removal opening 22, tangential inlet 26, inwardly projecting rib 34 and reinforcing ribs 39 are formed during the molding process for cost-effective manufacturing. The blasting medium bin, formed primarily by the conical portion 20, has a high capacity—5 gallons of blasting medium in a preferred embodiment—for extended use of the device without interruptions to add more blasting medium. The unit is initially charged with a supply of blasting medium and the 5 gallon capacity insures a prolonged operating cycle. If the medium becomes spent or contaminated, it may be readily removed as at the opening 22.

The wire shelf 36 rests on the rib 34 and the container 38 rests on the shelf 36 so that when filtrate accumulates in the container 38, the container can simply be removed and emptied.

The motor housing 14 is held together by the threaded rods 64 and comprises the substantially similar caps 46, 68 and 74. The caps 46 and 68 have centrally disposed openings 82 through which air is drawn by the blower 80. The handles 90 are affixed to the cap 68 at opposed sides thereof.

The filter assembly 42 is secured to the motor housing 14 by the V strap 48. The filter 58 may be changed simply by removing the wing nut 56 and plate 54.

Returning to FIG. 1, the present device 10 operates as follows: high pressure air from a pressure source P is fed to the blasting head 18 via an air conduit PC and causes medium M to be drawn by a Venturi action through supply tube 112 and ejected through the nozzle 116 against the work surface S.

Simultaneously, the motor 44 operates causing the blower 80 to generate a partial vacuum within the body 12 and the recovery hose 30. This causes air laden with blasting medium and dust from the surface S to be drawn into the bellows 126 and along the recovery hose 30, as indicated by the flow lines.

Upon entering the body 12 at the tangentially directed inlet 26, the laden air circulates to form a first stage cyclonic separator. The heavier blasting medium falls out of the air stream back into the blasting medium supply M in the lower end of the body 12.

The air stream, still laden with dust and medium which has been broken down, moves upward through the wire shelf 36, around the waste container 38 and to the second stage filter assembly 42. The dust and fine particulates are removed from the air stream and either cling to the filter surface or fall into the waste container 38, while the now clean air moves through the blower 80 and out of the expanded flattened motor guard 72.

The present invention thus provides a one piece body 12 with a high capacity blasting medium reservoir shaped for easy emptying and a high capacity filter system 42 including a foam sleeve 60 fitted over a heavy duty industrial filter 58. A resilient rubber bellows 126 over the end of the return nozzle 124 provides a secure seal between the return nozzle 124 and a surface S to be sandblasted to prevent the escape of the blasting medium M and dust. A cyclonic separator SC formed in the side of the molded body 12 efficiently separates dust and waste from the blasting medium M so that the blasting medium can be reused.

The present device 10 can be used with any types of blasting mediums including silica sand for abrasion, glass beads for polishing, and plastic blast media for paint removal from soft metal surfaces without damage to that surface. The present device 10 is especially useful with crushed fly ash or boiler slag sold under the tradename "Black Beauty" by H. B. Reed Company, which has been found to be inexpensive and effective.

It is apparent from the foregoing specification, that the invention is susceptible to being embodied with various alterations and modifications which may differ particularly from those that I have described in the preceding specification and description. It should be understood that I wish to embody within the scope of the patent granted hereon all such modifications as reasonably and properly come within the scope of my contribution to the art.

I claim as my invention:

1. A recirculating sandblasting device for use with a sandblasting medium to clean surfaces, comprising:

a body having a generally cylindrical portion and a generally conical portion at a first end of said cylindrical portion for holding said sandblasting medium, a motor housing at a second opposite end of said cylindrical portion, a motor mounted within said motor housing, a blower having a blower inlet and a blower outlet and being operatively connected to said motor within said motor housing to generate an air flow during operation of said motor, a filter arrangement mounted on said motor housing and extending into said cylindrical body portion, said filter arrangement connected to filter air entering said blower inlet, a tangentially directed inlet on said cylindrical body portion intermediate said first and second ends through which said air flow enters, a removable perforate shelf through which dust-laden air passes disposed laterally within said cylindrical body portion intermediate said filter arrangement and said tangentially directed inlet, a waste receiving container on said removable preforate shelf below said filter arrangement to catch material filtered from said air flow by said filter arrangement, said filter arrangement extending into said waste receiving container, a vacuum hose having a first end affixed to said tangential inlet and a second opposite end, a return nozzle affixed to said second opposite end of said vacuum hose to collect partical laden air to form said air flow, a sandblasting nozzle mounted extending into said return nozzle for projecting a blasting medium laden air stream, and a blasting medium supply hose connected extending between said conical body portion and said sandblastiing nozzle to carry said blasting medium from said conical body portion to said sand-blasting nozzle, whereby a stream of blasting medium laden air is projected against a surface by said sandblasting nozzle and then collected by said return nozzle for return to said body at said tangentially directed inlet for cyclonic separation and filtering.

2. A recirculating sand-blasting device as claimed in claim 1, further comprising:

a chute extending laterally adjacent an apex of said conical body portion through which sandblasting medium may be removed, gravitationally from said conical portion and a cap selectively attachable over said chute.

3. A recirculating sandblasting device as claimed in claim 1, further comprising:

a resilient bellows mounted on said return nozzle for placement against a surface, and said return nozzle defining an obtuse angle between said resilient bellows and said vacuum hose.

4. A recirculating sand-blasting device as claimed in claim 1, further comprising a wheeled cart mounting said body.

5. A recirculating sandblasting device as claimed in claim 1, wherein a portion of said return nozzle affixed to said vacuum hose defines an obtuse angle with a portion of said return nozzle into which said sandblasting nozzle extends and, further comprising:

a compression fitting affixed to said return nozzle for positioning and securing said sandblast nozzle from a surface.

6. A recirculating sandblasting device for use with a sandblasting medium to clean surfaces, comprising:

a body having a generally cylindrical portion and a generally conical portion at a first end of said cylindrical portion for holding said sandblasting medium, a motor housing at a second opposite end of said cylindrical portion, a motor mounted within said motor housing, a blower having a blower inlet and a blower outlet and being operatively connected to said motor within said motor housing to generate an air flow during operation of said motor, a filter arrangement mounted on said motor housing and extending into said cylindrical body portion, said filter arrangement connected to filter air entering said blower inlet, a tangentially directed inlet on said cylindrical body portion intermediate said first and second ends through which said air flow enters, a vacuum hose having a first end affixed to said tangential inlet and a second opposite end, a return nozzle affixed to said opposite end of said vacuum hose to collect particle laden air to form said air flow, a sandblasting nozzle mounted extending into said return nozzle for projecting a blasting medium laden air stream, a blasting medium supply hose connected extending between said conical body portion and said sandblasting nozzle to carry said blasting medium from said conical body portion to said sandblasting nozzle, whereby a stream of blasting medium laden air is projected against a surface by said sandblasting nozzle and then collected by said return nozzle for return to said body at said tangentially directed inlet for cyclonic separation and filtering, wherein said motor housing includes:

a first cover member having an annular ring disposed at its periphery with radial reinforcement rings, a perforate cylindrical guard mounted concentrically within said annular rim, a second cover member substantially identical to said first cover member and mounted on said cylindrical guard opposite said first cover member, and a third cover member mounted back-to-back with said second cover member and selectively mountable on said first end of said cylindrical body portion, whereby said cover members and cylindrical guard encase said motor and said blower and provide an exhaust path for said air flow.

7. A recirculating sandblasting device as claimed in claim 1, further comprising: a pick-up tube mounted extending angularly upward through said conical body portion, said supply hose affixed to an external end of said pick-up tube, a mitered end of said pick-up tube at an obtuse angle to a longitudinal axis of said pick-up tube.

8. A recirculating sandblasting device for use with a sandblasting medium to clean surfaces, comprising:

a rotationally molded body having a generally cylindrical portion with at least one inwardly directed rib disposed at an intermediate position along said cylindrical portion, a wire shelf removably supported on said at least one inwardly directed rib, a waste receiving container on said wire shelf, said waste receiving container being smaller than an inside diameter of said cylindrical body portion, a generally conical portion of said body at a first end of said cylindrical portion, said conical body portion including a removal opening adjacent an apex of said conical portion, a cap removably secured over said removal opening, a tangentially directed inlet on said body between said inwardly directed rib and said conical body portion, said tangentially directed inlet having a portion of gradually decreasing radius extending around segment of said cylindrical body portion, said portion of decreasing radius being in a plane normal to a longitudinal axis of said cylindrical body portion, a flexible vacuum hose having a first end affixed to said tangentially directed inlet, a return nozzle affixed to a second end of said vacuum hose, said return nozzle including a head portion and a hose fitting portion at an obtuse angle to said head portion, a flexible bellows mounted on said head portion of said return nozzle, said bellows having a surface engaging orifice opposite said head portion, a sandblast gun having a nozzle received in said return nozzle to direct a particle laden air stream through said bellows orifice, said sand blast gun including means for selectively transmitting a high pressure air supply, a blasting medium pick-up tube extending through said conical body portion, a blasting medium conduit connected between said sandblast gun and said pick-up tube, a motor housing selectively mountable at a second opposite end of said cylindrical body portion including a first end cap for engaging said cylindrical body portion and a second end cap spaced from said first end cap, an expanded flattened metal cylinder extending between said first and second end caps, a motor and blower assembly including an air inlet and an air outlet mounted within said motor housing and operable to draw air in through said air inlet and exhaust air through said air outlet, a filter mounted over said air inlet and extending from said motor housing into said cylindrical body portion, and means for supplying power to said motor and blower assembly, a cart on which said body is mounted.

9. A device as claimed in claim 8, wherein: said bellows is of rubber having a flexibility of between 60 to 65 Durometer.

10. A device as claimed in claim 8, wherein: said filter extends into said waste receiving container.

11. A device as claimed in claim 8, wherein: said cart is a two-wheeled hand cart.

12. A recirculating sandblaster comprising, an upright cylindrically nested array of telescoped parts comprising, a lowermost element comprising a base made of rotationally molded plastic material shaped to form a conical collecting chamber having inwardly converging walls formed with a lateral removal opening adjacent the apical terminus, said base element having formed above said collecting chamber a filter chamber and a motor-blower chamber, a removable grid separating said collecting chamber and said filter chamber, a bucket on said grid nested in said base and receiving a filter assembly therein in nested relation to both said bucket and said base, a motor-fan unit mounted in the top of said base superjacent said filter assembly, a nozzle powered by pressurized air and having a flexible rubber collecting shield at the end thereof for sealingly engaging the adjoining surfaces of a work surface to be abraded, a return conduit connected to said shield at one end, said return conduit being connected at its opposite end to a tangentially disposed inlet formed in said base above the level of said conical collecting chamber, said base forming a cyclone separator for effecting a first stage separation of particulate matter from an air stream, a grit supply conduit connected to said nozzle and to said conical chamber, said grit supply conduit having a pick-up tube extending into said conical chamber for picking up a supply of grit for transmission to the nozzle, and a wheeled hand cart support having a pair of wheels and a corresponding pair of feet opposite said wheels with a frame therebetween to receive and support said telescoped parts, whereby said sandblaster can be utilized with minimal risk of contaminating a working environment with residual waste.

* * * * *